United States Patent [19]

Hautala

[11] Patent Number: 5,064,125

[45] Date of Patent: Nov. 12, 1991

[54] PULPER

[75] Inventor: Jouko Hautala, Tempere, Finland

[73] Assignee: Oy Tampella Ab, Tampere, Finland

[21] Appl. No.: 533,417

[22] Filed: Jun. 5, 1990

[30] Foreign Application Priority Data

Jun. 5, 1989 [FI] Finland ..... 892737

[51] Int. Cl.[5] ..... B02C 23/36

[52] U.S. Cl. ..... 241/46.17; 241/69

[58] Field of Search ..... 162/4; 241/46.11, 46.17, 241/46.06, 69, 166, 46.08

[56] References Cited

U.S. PATENT DOCUMENTS 2,384,326 9/1945 Martindale ..... 241/69
4,619,736 10/1986 Henricson et al. ..... 241/46.11 X
4,941,970 7/1990 Ahs ..... 241/46.17 X

FOREIGN PATENT DOCUMENTS 832106 12/1983 Finland .
834391 1/1985 Finland .

*Primary Examiner*—Mark Rosenbaum

*Attorney, Agent, or Firm*—Pollock, Vande Sande & Priddy

[57] ABSTRACT

An apparatus for pulping and screening materials containing fiber pulp includes an upper pulping section for breaking down the materials and a lower screening section for prescreening of the broken materials. The pulping section includes a feeding chamber delimited by a housing, a rotor unit in the feeding chamber, a drive unit for rotation of the rotor unit and a first perforated screenplate in a bottom portion of the pulping section through which an accepted portion of the broken material is fed into the screening section. The screening section includes a space also delimited by a housing and positioned on the opposite side of the first perforated screenplate and a stationary partition wall for dividing the space into a first and a second partial space. At least a portion of the partial wall defines a second perforated screenplate. The first partial space communicates with the feeding chamber for receiving the accepted portion of the broken material. The second partial space through the second screenplate receives accepted materials from the first partial space. Also, a cleaning device is provided in the first partial space and is rotatable with respect to the second screenplate.

14 Claims, 1 Drawing Sheet

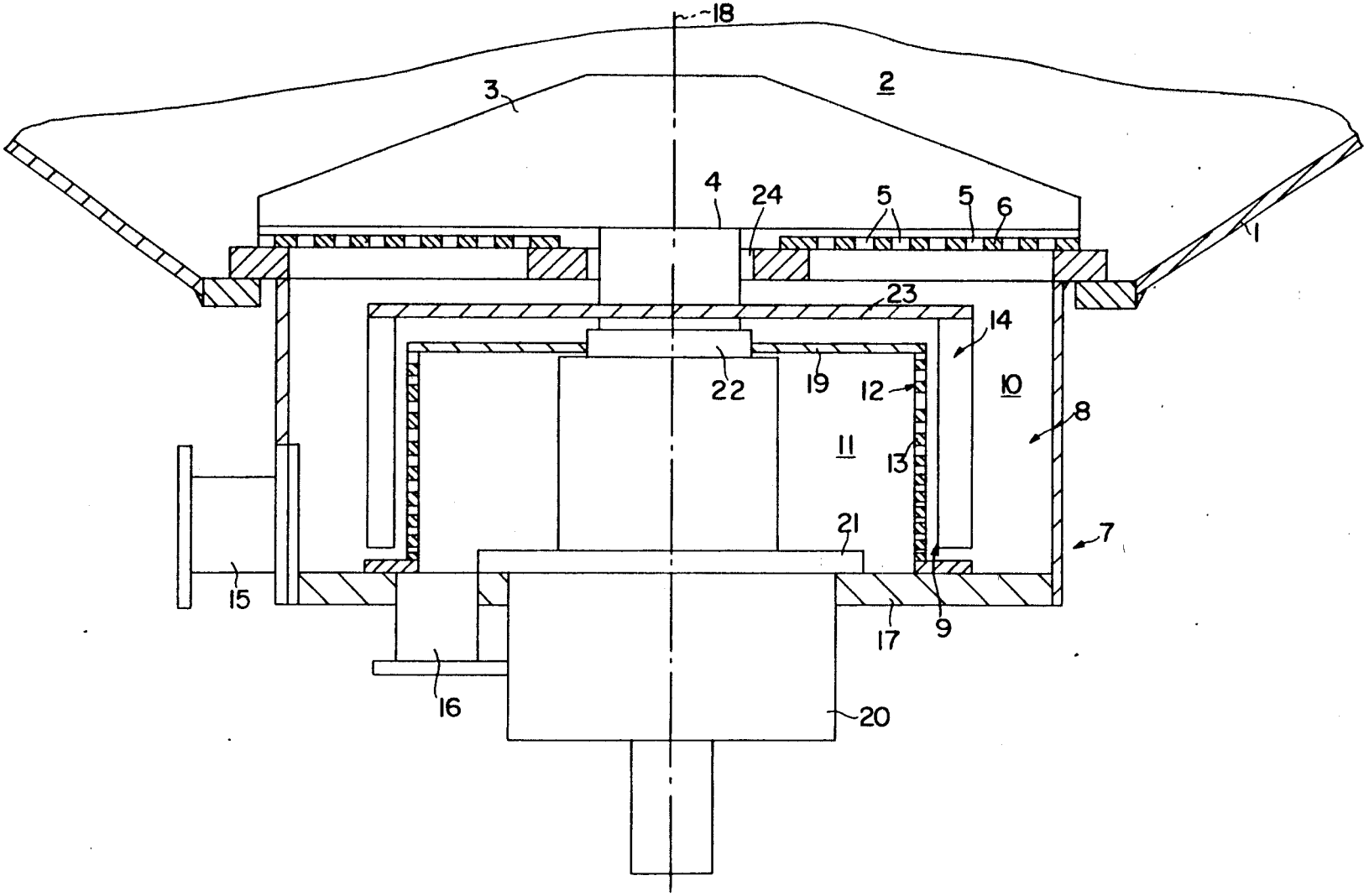
1
2
3
4
5
5
6
7
8
9
10
11
12
13
14
15
16
17
18
19
20
21
22
23
24

PULPER

FIELD OF THE INVENTION

The present invention relates to a pulper for breaking materials containing fiber pulp, more particularly for breaking materials containing paper pulp or the like. The pulper according to the invention comprises a feed chamber restricted by the pulper housing, a rotor unit or the like in the feed chamber adapted to be moved by means of a drive unit, a screenplate with perforations in connection with the rotor unit or the like, a space restricted by a housing or the like and situated, as seen from the rotor unit or the like, on the opposite side of the perforated screenplate for receiving the broken material.

BACKGROUND OF THE INVENTION

Several different solutions are known for this kind of pulpers. Particularly so-called vertical pulpers, canal or horizontal pulpers are known in the art of the processing of fiber pulp. In addition, a so-called secondary pulper construction is known.

In such known apparatuses, only breaking of the pulp is performed. The broken pulp is conducted to subsequent process stages, especially to different screening stages.

SUMMARY OF THE INVENTION

The object of this invention is to upgrade the state of art in the field of fiber pulp handling so that the pulp broken in the pulper can be pre-screened in the pulper unit itself. In order to attain this object the pulper according to this invention is provided with a space, housing a screening unit and including

- a first partial space which is in direct connection with the screenplate connected with the rotor unit or the like, and which is provided with a discharge connection unit for the rejected portion of the pulp,
- a second partial space for the accepted portion, which partial space is provided with a discharge connection unit for the accepted portion of the pulp,
- a partition wall construction or the like between the said first and second partial spaces, consisting at least partly of a perforated screenplate and
- a cleaning device movable relative to the screenplate by means of a drive unit.

Several advantages are attained by the above solution as compared with the prior art. Particularly beneficial is the fact that broken pulp can be prescreened immediately after breaking wherefore the rejected portion can be conducted immediately back into the feed chamber. The screening unit substitutes the so-called HC-cleaner (high consistency cleaner), for example in waste paper pulpering. The screening unit according to the invention has a very simple structure. Also, several constructional advantages are attained.

The present invention is further illustrated in the following description by reference to the embodiment shown in the enclosed drawing.

BRIEF DESCRIPTION OF THE DRAWINGS

The FIGURE shows one embodiment of the pulper according to present invention as a partial cross-section at the bottom level of the pulper, wherein the screening unit is connected to the lower part of the pulper.

DETAILED DESCRIPTION OF THE PREFERRED EMBODIMENT(S)

In the drawing, the pulper housing 1 restricts the feed chamber 2. The feed chamber 2 accommodates a rotor unit 3 or the like. The rotor unit 3 is attached to the vertical shaft 4, the drive unit for rotating the rotor unit 3 being connected thereto. A screenplate 6 with perforations 5 is located under the rotor unit 3. As to the technical solutions concerning the rotor unit 3 and the perforated screenplate 6 reference can be made, for example, to the U.S. Pat. No. 3,889,885. Since such rotor units and screenplates are commonly known in the field, they will not be explained further in detail in the specification.

The apparatus includes a space 8 restricted by the housing unit 7, and situated on the opposite side of the perforated screenplate 6 as seen from the rotor unit 3 or the like, to which space the fiber material from the feed chamber 2 is transferred through screenplate 6 guided by the rotor unit 3.

According to the present invention the space 8 houses therein screening unit 9. The screening unit 9 consists of the partition wall construction 12, which at least partly consists of the perforated screenplate 13, and the cleaning device 14. The screening unit divides the space 8 into a first partial space 10 and a second partial space 11.

The first partial space 10 is in direct communication with the screenplate 6 which is in connection with the rotor unit 3. The first space 10 accommodates the discharge connection unit 15 which is placed on the outer surface of housing unit 7, in its lower part.

The second partial space 11 for the accepted portion includes a discharge connection unit 16 preferably placed on the end part 17 of housing unit 7.

The housing 7 which delimits the space 8 preferably has a cylindrical form wherefore the center line 18 of the cylindrical form coincides with the center line of shaft 4. Screenplate 13 has also a cylindrical form and it is so arranged that its center line coincides with the center line 18 of housing unit 7. The end part 17 of housing 7 forms the first end part of the second partial space 11. The second end part of the second partial space 11 is formed by a closed part 19, which is substantially parallel with the perforated screenplate 6, of the partition wall construction 12.

The shaft 4 is fitted to pass through the second partial space 11 wherefore a bearing unit 20 is disposed on the outside of the end part 17 of the housing 7 and is connected by a flange 21 to the end part. The shaft 4 is provided with a sealing unit 22 by the closed part 19 of the partition wall construction 12, the sealing unit preferably comprising a combination of a strip-like and/or a mechanical seal. A supporting structure 23 extending radially from the shaft 4 is attached to the shaft 4 in the first partial space 10 between the closed part 19 and the perforated screenplate 6. A cleaning device 14, extending downwards and comprised of blade-like elongated form parts, is attached to the end of the supporting structure 23. The blade-like form parts are disposed at specific distances on the circumference of the supporting structure 23. The purpose of the cleaning device is to maintain the perforations of the screenplate 13 unplugged wherefore the form parts move along the screenplate 13 in the first partial space 10. In this connection it can be stated that the cleaning device 14 can also be placed on the side of the second partial space 11 by means of a similar supporting structure as shown in the drawing either as an alternative or in addition to the construction shown in the drawing.

The cleaning device 14 and the rotor unit 3 or the like, in the embodiment according to the invention, are provided with a common drive unit (not shown) by which the shaft 4 operates both assemblies moving relative to the pulper. As shown in the enclosed drawing the cleaning device 14 and the rotor unit 3 or the like are connected to the same shaft 4. The bearing unit 20 can be provided with a gear reducer.

Shaft 4 is adapted to pass through the perforated screenplate 6. Then an annular slot 24 can be left between the outer surface of the shaft 4 and the screenplate 6 which can serve preferably as part of the perforation of the screenplate 6.

I claim:

1. An apparatus for pulping and screening materials containing fiber pulp, said apparatus comprising: an upper part defining a pulping section for breaking down said materials and a lower part defining a screening section for prescreening said broken materials;

said pulping section including:

a feeding chamber delimited by a housing, a rotor unit positioned in said feeding chamber, a drive unit for rotation of said rotor unit and a first perforated screenplate in a bottom portion of said pulping section through which an accepted portion of said broken material is fed into said screening section;

said screening section including:

a space also delimited by a housing and positioned on the opposite side of said first perforated screenplate, a stationary partition wall for dividing said space into a first partial space and a second partial space;

at least a portion of said partition wall including a second perforated screenplate;

said first partial space being in communication with said feeding chamber for receiving said accepted portion of said material through said first screenplate;

said second partial space being in communication with said first partial space through said second screenplate for receiving material accepted by said second screenplate;

a first partial discharge outlet in communication with said first space for discharging the portion of material rejected by said second screenplate;

a second discharge outlet in communication with said second partial space for discharge of the portion of said material accepted by said second screenplate; and a cleaning device provided in said first partial space and rotatable with respect to said second screenplate of said partition wall.

2. An apparatus according to claim 1, wherein said housing defining said space is substantially cylindrical and wherein said second screenplate is also arranged to form a substantially cylindrical surface, the center line of which is parallel with the center line of said housing, said cylindrical surface formed by said second screenplate being restricted at least partly by the bottom of said housing and on the opposite end at least partly by a part of said partition wall.

3. An apparatus according to claim 1, wherein a shaft of said cleaning device, which is connected to a drive unit, is adapted to pass through the second partial space and wherein a supporting structure extending radially from said shaft is connected to said shaft, said supporting structure supporting, at its end part, elongated, blade-like members constituting said cleaning device.

4. An apparatus according to claim 3, wherein said shaft is sealed at a part of said partition wall between said first and said second partial spaces.

5. An apparatus according to claim 3, wherein a reduction gear is provided between said drive unit and said rotor unit and said cleaning device.

6. An apparatus according to claim 3, wherein said shaft is sealed at a part of the partition wall between said first and said second partial spaces.

7. An apparatus according to claim 3, wherein said shaft is adapted to pass through said first perforated screenplate in connection with said rotor unit, and wherein an annular slot remains present between the outer surface of said shaft and said first screenplate which functions as part of the perforation of said first screenplate.

8. An apparatus according to claim 3, wherein said rotor unit and said cleaning device are provided with a common drive unit and wherein said rotor unit and the supporting structure of said cleaning device are connected to a common shaft.

9. An apparatus according to claim 8, wherein said shaft is adapted to pass through said first perforated screenplate in connection with the rotor unit, and wherein an annular slot remains present between the outer surface of said shaft and the screenplate which functions as part of the perforation of said first screenplate.

10. An apparatus according to claim 1, wherein a reduction gear is provided between said drive unit and said rotor unit.

11. An apparatus for breaking down and prescreening materials containing fiber pulp, comprising:

a feeding chamber defined by a housing;

a rotor unit located in said feeding chamber and rotatable by a drive unit, a first perforated screenplate in connection with said rotor unit in a bottom portion of the feeding chamber, a space defined by a housing on the opposite side of said first perforated screenplate for receiving the broken material;

said space including a screening unit defined by:

a first partial space with is in direct communication with said first screenplate and which is provided with a discharge connection unit for the portion of the broken material rejected by said screening unit;

a second partial space for the accepted portion of the broken material, said second partial space being provided with a discharge connection unit for the accepted portion;

a stationary partition wall provided between said first and second partial spaces and including, at least in part, a second perforated screenplate; and a cleaning device adapted to be rotated relative to said second screenplate by a drive unit and positioned inside said first partial space.

12. An apparatus according to claim 11, wherein a shaft of said cleaning device, which is connected to a drive unit, is adapted to pass through the second partial space and wherein a supporting structure extending radially from said shaft is connected to said shaft, said supporting structure supporting, at its end part, elongated, blade-like members constituting said cleaning device.

13. An apparatus according to claim 11, wherein a reduction gear is provided between said drive unit and said rotor unit.

14. An apparatus according to claim 11, wherein a shaft is adapted to pass through said first perforated screenplate, and wherein an annular slot remains between the outer surface of said shaft and said first screenplate which functions as part of said first screenplate.

* * * * *